US007127773B2

(12) United States Patent
Nowottnick et al.

(10) Patent No.: US 7,127,773 B2
(45) Date of Patent: Oct. 31, 2006

(54) DAMP-WIPING CLOTH, SPONGE OR THE LIKE AND METHOD FOR ITS MANUFACTURE

(75) Inventors: Heike Nowottnick, Weinheim (DE); Dirk Schubert, Leutershausen (DE); Jochen Wirsching, Birkenau (DE); Hans-Jürgen Wendelken, Sinsheim (DE)

(73) Assignee: Carl Freudenberg KG(DE)

( * ) Notice: Subject to any disclaimer, the term of this patent is extended or adjusted under 35 U.S.C. 154(b) by 441 days.

(21) Appl. No.: 10/186,100

(22) Filed: Jun. 28, 2002

(65) Prior Publication Data

US 2003/0005534 A1 Jan. 9, 2003

(30) Foreign Application Priority Data

Jul. 4, 2001 (DE) ..... 101 31 878

(51) Int. Cl.
*A47K 7/02* (2006.01)
*A47L 13/10* (2006.01)
*A47L 13/144* (2006.01)

(52) U.S. Cl. ..... 15/244.4; 15/244.1

(58) Field of Classification Search ..... 15/244.1, 15/244.3, 244.4

See application file for complete search history.

(56) References Cited

U.S. PATENT DOCUMENTS

| | | | | |
|---|---|---|---|---|
| 3,570,036 | A | 3/1971 | Gilchrist et al. | |
| 3,694,845 | A * | 10/1972 | Engelsher | 15/244.4 |
| 4,111,666 | A * | 9/1978 | Kalbow | 51/295 |
| 4,240,760 | A * | 12/1980 | Levine | 401/201 |
| 5,548,862 | A * | 8/1996 | Curtis | 15/118 |
| 5,640,737 | A * | 6/1997 | Boggs | 15/118 |
| 6,485,822 | B1 * | 11/2002 | Osiecki et al. | 428/316.6 |
| 2001/0029967 | A1 * | 10/2001 | McDonough | 134/6 |

FOREIGN PATENT DOCUMENTS

| | | |
|---|---|---|
| DE | 1 628 663 | 10/1970 |
| DE | 25 56 277 | 6/1977 |
| DE | 299 14 621 | 12/1999 |
| FR | 2733 895 | 11/1996 |

* cited by examiner

*Primary Examiner*—Randall Chin
(74) *Attorney, Agent, or Firm*—Kenyon & Kenyon LLP

(57) ABSTRACT

A damp-wiping cloth (e.g., a sponge or the like) from a foam body of flexible foam material, the foam body (2) being interspersed with foam strips (3) whose hardness is greater than the hardness of the foam body (2).

16 Claims, 4 Drawing Sheets

DAMP-WIPING CLOTH, SPONGE OR THE LIKE AND METHOD FOR ITS MANUFACTURE

BACKGROUND OF THE INVENTION

1. Field of the Invention

The invention relates to various kinds of wiping cloths (e.g., sponges) that are used to clean the floor or other surfaces in households.

2. Description of Related Art

The wiping cloths may have a simple structure in that they are formed from a sponge-type material, for instance. It is important that the wiping cloth absorbs the dirt from the surface to be cleaned and releases it again during the wringing-out process. In order to remove even baked-on dirt, wiping cloths have become known in which two different materials are superposed on top of one another. One layer is primarily used to absorb water, and the other is used as scrubbing surface. A mop made up of an internally located sponge and two side surfaces from different materials has found wide distribution. One side is implemented as swab, while the other side is made of a non-woven fabric and has an especially high absorbency. For the wringing-out process, two rollers are guided across the sponge and the water is squeezed out in this manner. As an alternative, the wiping mop may also be implemented by using two foldable sponge-holding devices ("butterfly mop"), which may be squeezed out against each other by a roller mechanism.

A wiping cloth has become known from German utility model patent No. 299 14 621 U1, which is made up of at least one hydrophilic foam-type layer and an abrasion-proof hydrophilic layer arranged on its underside and an abrasion-proof second hydrophilic layer arranged on the topside. In this manner, a high degree of absorbency of the central, foam-type layer is achieved, which is protected on its top and bottom side by an individual abrasion-proof layer. Such a wiping cloth finds many uses.

From the laid-open document DE-OS 25 56 277, a floor mop has become known, which consists of a holder with wiping strips attached thereto. Such a floor mop is relatively easy to manufacture, but the wringing-out the absorbed water creates difficulties.

SUMMARY OF THE INVENTION

It is an object of the invention to provide a method of improving the heretofore known wiping cloths/mops or scrubbing sponges in such a way that a simple and reliable wringing-out of the absorbed dirty water is ensured.

These and other objects of the invention are achieved by a damp-wiping cloth (e.g., sponge) made from a sponge body of flexible foam material, in which the foam body is interspersed with foam strips whose hardness is greater than the hardness of the foam body. By these measures, harder application surfaces for the flexible foam material are formed inside the foam body of flexible foam material, by which a faster and easier wringing-out of the absorbed dirty water from the foam body is achieved.

BRIEF DESCRIPTION OF THE DRAWINGS

The present invention will be described in greater detail with reference to the following drawings wherein.

DETAILED DESCRIPTION OF THE INVENTION

The foam strips may be manufactured in a very simple manner by heat-sealing zones of individual foam-body parts of flexible foam material. For this purpose, individual foam-body parts are formed from flexible foam material, which are heat-sealed to one another. By the heat-sealing process, the bonding surfaces are made harder than the foam body itself, and the desired easier wringing-out process is achieved.

Especially stable foam strips are formed if individual harder foam parts of rigid foam material are incorporated in the foam body. To intensify the abrasion and scrubbing capability, these foam strips may be arranged in such a manner that they project from the foam body of flexible foam material with their lower and/or upper edges.

In order to achieve an unimpeded discharge of the dirty water from the foam body, the foam strips are preferably arranged diagonally in the foam body. To increase the scrubbing capacity, the foam body may finally be provided on at least one of its surface with an abrasion-proof layer of abrasion-proof non-woven material, abrasive coating, PU foam (rigid foam) or some other cloth material.

The flexible foam material preferably is made of polyurethane or cellulose or their blends. In contrast, the harder foam strips are preferably made of polyolefins, polyurethane and their blends. In this context, it is advantageous if the foam strips have larger pores than the foam body itself.

In the manufacture of the damp-wiping cloth, a foam layer of flexible foam material may first be cut into sections whose specified number and width are heat-bonded or laminated to one another at the cutting surfaces or are joined in some other fashion. When incorporating harder foam strips into the flexible foam material, a plurality of foam layers of flexible foam material and of harder foam material are layered on top of one another and joined.

In this way, a foam web consisting of a plurality of superposed layers of flexible foam material and of harder foam strips is created, which are joined to one another, and the foam web is subsequently cut into individual pieces at an angle to its plane. Additionally, the foam web may be cut vertically to its longitudinal direction to obtain the individual mops.

Figure 1:
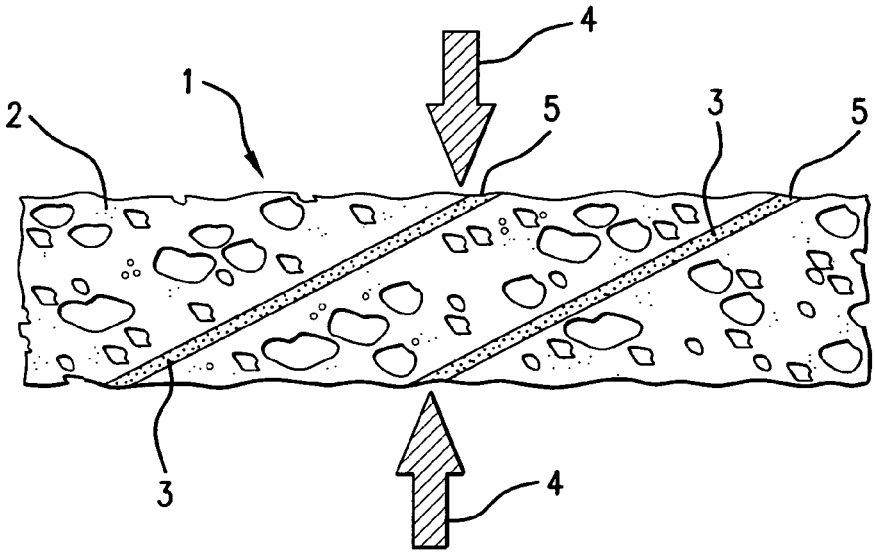
FIG. 1 shows a section from a wiping cloth with incorporated foam strips.

FIG. 1 shows a cross section of a wiping cloth/mop 1, which is made up of a foam body 2 of flexible foam material and is interspersed with foam strips 3. The material used for foam strips 3 has a greater hardness than that of foam body 2. By compressing damp-wiping cloth 1 as indicated by arrows 4, the dirty water is removed from damp-wiping cloth 1 with the foam strips more easily and completely than is the case if no foam strips 3 are present. In the present example, foam strips 3 are incorporated into foam body 1 by an adhesive procedure. Foam strips 3 slightly project from foam body 2 with their upper edges 5, so that the topside of damp-wiping cloth 1 has a greater scrubbing capacity than the bottom side of damp-wiping cloth 1. In order to impede the draining of the dirty water as little as possible when wringing out, foam strips 3 are arranged in foam body 2 in diagonal fashion.

Figure 2A:
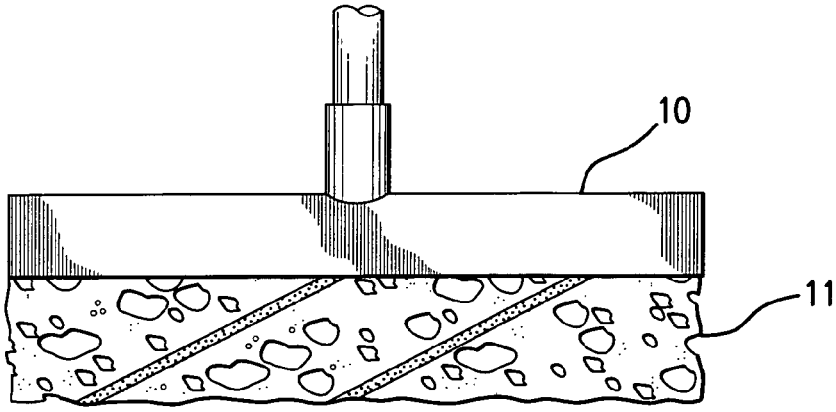
FIGS. 2*a* through 2*c* shows a mop with foam strips in its functional steps.
Figure 2B:
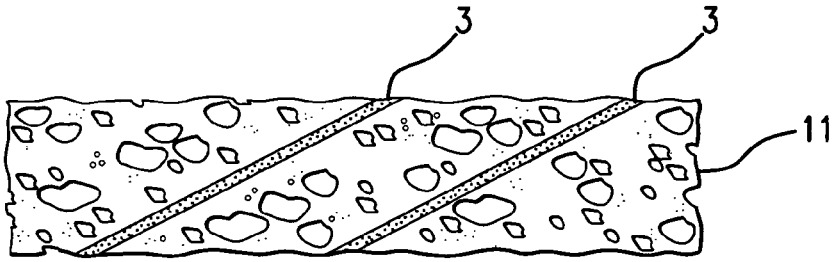
Figure 2C:
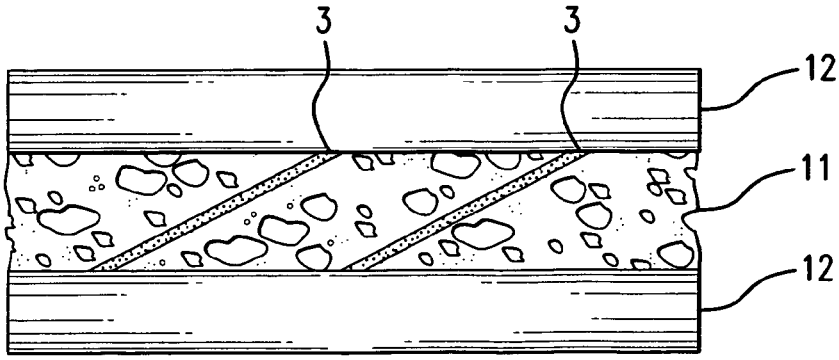

FIGS. 2*a*, 2*b* and 2*c* show a wiping-mop 11 supported in a holding device 10, in which the wiping-mop is also provided with foam strips 3. FIG. 2*a* shows the holding device 10 with wiping-mop 11 in a side view. FIG. 2*b* shows wiping-mop 11 in a view from below. Foam strips 3 incorporated in wiping-mop 11 are visible. For the wringing-out procedure, rollers 12 attached to holding device 10 are pressed down and wiping-mop 11 thereby compressed. FIG. 2*c*, also in a view of wiping-mop 11 from below, shows the compression procedure. The dirty water is squeezed out of wiping-mop 11, foam strips 3 considerably facilitating this process.

Figure 3:
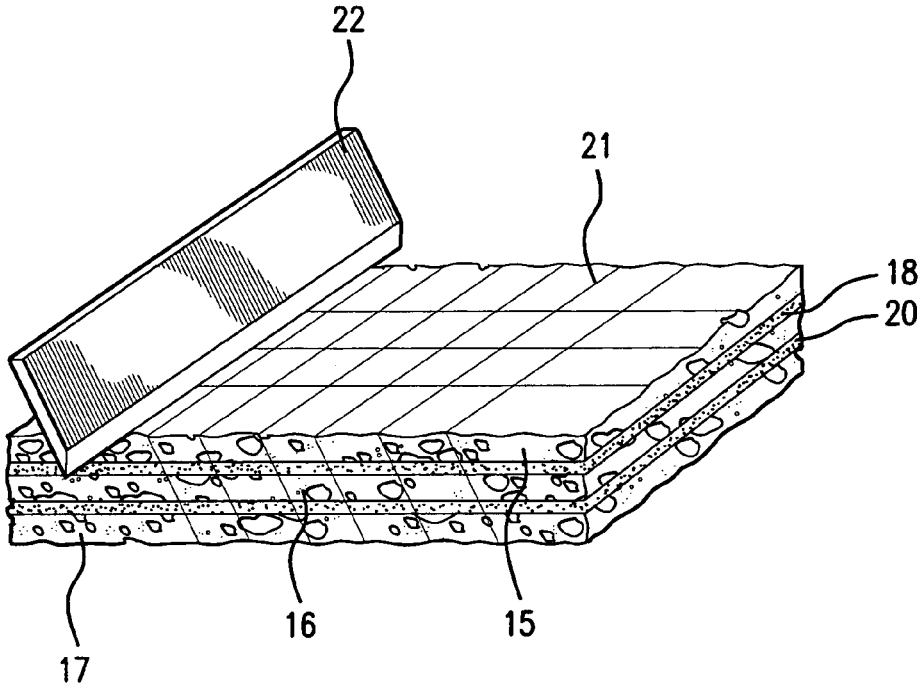
FIGS. 3 and 4 the manufacturing options for mop components.

FIG. 3 shows a possible manufacturing process for a mop/wiping cloth, as it has been used in FIGS. 2*a* through 2*c*. In this context, a predefined number of foam layers 15, 16, 17 and foam-strip layers 18, 20 are joined to one another. Foam layers 15, 16, 17 are made of polyurethane or cellulose and their blends, while foam strips 18, 20 are made of polyolefin. Knife 22 cuts this foam web 21 into separate parts at an angle to its plane, and, in addition, these separate parts are vertically cut in their longitudinal direction. Each separate part produced by the horizontal and vertical cuts forms a wiping-mop 11.

Figure 4:
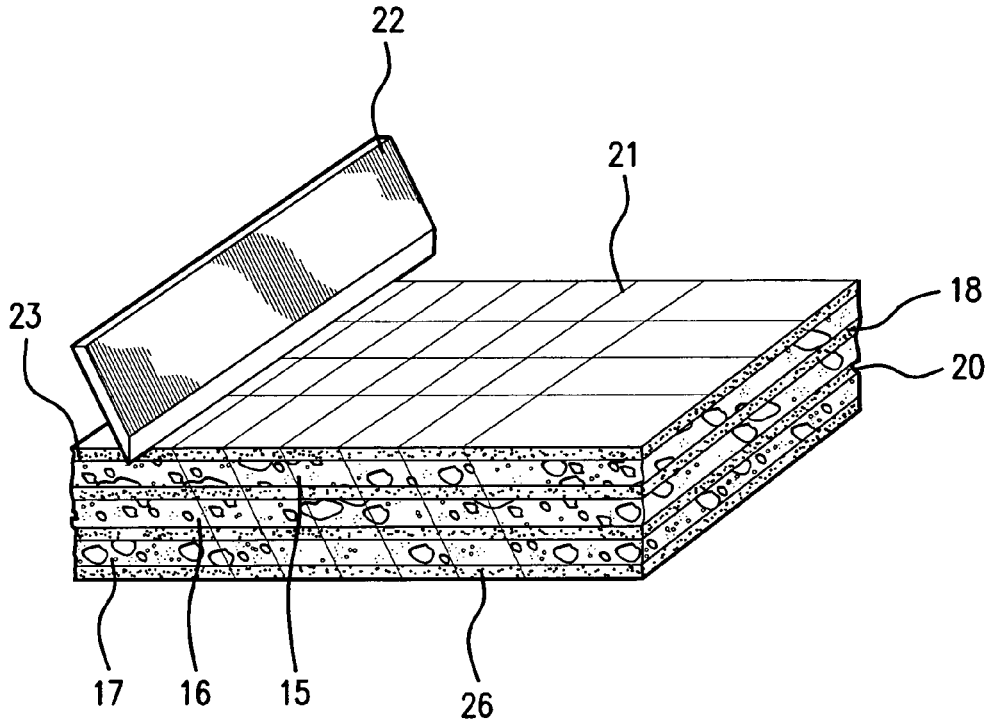

FIG. 4 shows an exemplary embodiment of a foam web 21 having the fundamental structure of foam web 21 in FIG. 3, but is additionally provided with abrasion-proof layers 23 and 24 on the top and bottom sides, respectively, of foam web 21.

What is claimed is:

1. A damp-wiping cloth comprising a sponge body of flexible foam material, wherein the foam body (2) is interspersed with foam strips (3) whose hardness is greater than the hardness of the foam body (2), at least a portion of the foam body (2) lying between two of the foam strips (3), and wherein the foam strips (3) project with their lower edges or upper edges (5) from the foam body (2) of flexible foam material.

2. The damp-wiping cloth according to claim 1, wherein the foam strips (3) are produced by heat-sealing zones of the flexible foam material.

3. The damp-wiping cloth according to claim 1, wherein the foam strips (3) are made of individual harder foam parts from rigid foam material.

4. The damp-wiping cloth according to claim 1, wherein the foam strips (3) are diagonally arranged in the foam body (2).

5. The damp-wiping cloth according to claim 1, wherein the foam body (2) is provided at least on one of its surfaces with an abrasion-proof layer (23, 24) of abrasive non-woven material, abrasive coating, PU-foam (rigid foam) or another cloth material.

6. The damp-wiping cloth according to claim 1, wherein the flexible foam material is made of polyurethane, cellulose, regenerated allulose, lyocell or blends thereof.

7. The damp-wiping cloth according to claim 1, wherein the harder foam strips are made of polyolefins, polyurethanes or their blends.

8. The damp-wiping cloth according to claim 1, wherein the foam strips (3) have larger pores than the foam body (2) of flexible foam material.

9. The damp-wiping cloth according to claim 1, wherein the cloth is a sponge.

10. The damp wiping cloth of claim 1, further comprising a wringing mechanism configured to squeeze the sponge body.

11. The damp wiping cloth of claim 1, further comprising a holding device configured to hold the foam body (2).

12. A damp-wiping cloth comprising a sponge body of flexible foam material and a wringing mechanism configured to squeeze the sponge body, wherein the foam body (2) is interspersed with foam strips (3) whose hardness is greater than the hardness of the foam body (2), wherein the foam strips (3) are diagonally arranged across a width of the foam body (2), wherein the foam strips (3) extend from a first surface of the foam body (2) to an opposing surface of the foam body (2) along a height of the foam body (2), and wherein the wringing mechanism squeezes the foam body (2) by moving at least one of the first surface and the second surface relative to the other of the first surface and second surface.

13. The damp-wiping cloth according to claim 12, wherein the foam strips (3) project with their lower edges or upper edges (5) from the foam body (2) of flexible foam material.

14. The damp-wiping cloth according to claim 12, wherein the foam body (2) is provided at least on one of its surfaces with an abrasion-proof layer (23, 24) of abrasive non-woven material, abrasive coating, PU-foam (rigid foam) or another cloth material.

15. The damp-wiping cloth of claim 12, further comprising a holding device configured to hold the sponge body.

16. The damp wiping cloth of claim 12, wherein the foam strips (3) have larger pores than the foam body (2) of flexible foam material.

* * * * *